US007104669B1

(12) United States Patent
Mogilevsky Piankov

(10) Patent No.: US 7,104,669 B1
(45) Date of Patent: Sep. 12, 2006

(54) DECORATIVE SCONCE-LIKE ARTICLE FOR DISPLAYING ENVIRONMENTAL ELEMENTS

(76) Inventor: Olga Mogilevsky Piankov, 42-20 Kissena Blvd. Entrance IV, Suite BN, Flushing, NY (US) 11355

( * ) Notice: Subject to any disclaimer, the term of this patent is extended or adjusted under 35 U.S.C. 154(b) by 64 days.

(21) Appl. No.: 10/944,971

(22) Filed: Sep. 20, 2004

(51) Int. Cl.
*F21L 4/00* (2006.01)
*F21L 19/00* (2006.01)

(52) U.S. Cl. ..... 362/147; 362/159

(58) Field of Classification Search ..... 362/147, 362/159–161, 163; D26/72, 80, 85, 9, 22, D26/74, 113, 114, 118
See application file for complete search history.

(56) References Cited

U.S. PATENT DOCUMENTS 5,101,328 A * 3/1992 Hai ..... 362/163
D487,529 S * 3/2004 Kowitz ..... D26/85
2004/0001338 A1* 1/2004 Pine ..... 362/161

OTHER PUBLICATIONS www.dictionary.com/sconce-Jan. 19, 2006-p. 1.*

* cited by examiner

*Primary Examiner*—Renee Luebke
*Assistant Examiner*—David Makiya
(74) *Attorney, Agent, or Firm*—Michael I Kroll

(57) ABSTRACT

Apparatus for a decorative ornamental structure for canned fuels 30, including solid and liquid fuels that is provided in a plurality of sizes. The decorative ornamental structure is composed of spaced apart sconce-like elements 14, 16 having a backing 20 positioned therebetween. The sconce-like elements 14, 16 can be formed in shapes comprising curved surfaces, such as a quarter sphere or polygonal surfaces, such as triangular, quadrilateral or trapezoidal shaped and can be provided in various colors. The sconce-like element 14, 16 cavities face each other with a planar back plate 20 forming an integral part therewith, whereby the decorative ornamental structure can be wall 12 mounted. The base sconce-like element 16 forms the container for the canned fuel 30 and is of such dimension as to receive additional decorative articles 24, such as stones giving the appearance of flames emanating from a rock bed.

14 Claims, 8 Drawing Sheets

DECORATIVE SCONCE-LIKE ARTICLE FOR DISPLAYING ENVIRONMENTAL ELEMENTS

BACKGROUND OF THE INVENTION

Field of the Invention

The present invention relates generally to fireboxes and, more specifically, to a decorative ornamental structure for canned fuels, including solid and liquid fuels that is provided in a plurality of sizes.

The decorative ornamental structure is composed of spaced apart sconce-like elements having a backing positioned therebetween. The sconce-like elements can be formed in shapes comprising curved surfaces, such as a quarter sphere or polygonal surfaces, such as triangular, quadrilateral or trapezoidal shaped and can be provided in various colors.

The sconce-like element cavities face each other with a planar backplate forming an integral part therewith, whereby the decorative ornamental structure can be wall mounted.

The base sconce-like element forms the container for the canned fuel and is of such dimension as to receive additional decorative articles, such as stones giving the appearance of flames emanating from a rock bed.

The decorative ornamental structure incorporating the containerized fuel and decorative bed articles forms an art ensemble designed to bring the energy of an environmental element (fire) into one's own environment (home) creating an aesthetic quality and harmony as recited in the teaching of Feng Shui.

DESCRIPTION OF THE PRIOR ART

There are other firebox devices designed for containerized fuels, which are typically free standing devices having the appearance of fireplaces. The fuel is also commonly used in the food preparation industry to keep the food warm, such as a buffet.

There are other structures, which provide for the use of containerized fuels. While these structures may be suitable for the purposes for which they where designed, they would not be as suitable for the purposes of the present invention as heretofore described.

It is thus desirable to provide a decorative ornamental wall mountable structure for the positioning therein of containerized fuels.

It is further desirable to provide a decorative ornamental article wherein additional decorative article can be positioned around the fuel cells.

SUMMARY OF THE PRESENT INVENTION

The present invention discloses a decorative ornamental structure for canned fuels, including solid and liquid fuels that are provided in a plurality of sizes. The decorative ornamental structure is composed of spaced apart sconce-like elements having a backing positioned therebetween. The sconce-like elements can be formed in shapes comprising curved surfaces, such as a quarter sphere or polygonal surfaces, such as triangular, quadrilateral or trapezoidal shaped and can be provided in various colors. The sconce-like element cavities face each other with a planar back plate forming an integral part therewith, whereby the decorative ornamental structure can be wall mounted. The base sconce-like element forms the container for the canned fuel and is of such dimension as to receive additional decorative articles, such as stones giving the appearance of flames emanating from a rock bed.

A primary object of the present invention is to provide a decorative article incorporating containerized fuel that can be wall mounted.

Another object of the present invention is to provide a decorative article comprised of a material that is heat tolerant.

Yet another object of the present invention is to provide a decorative article incorporating means for supporting and encompassing a fuel container.

Still yet another object of the present invention is to provide a decorative article wherein the article supporting means provides for the inclusion of other heat tolerant decorative elements, such as rocks, sand or glass gravel.

Another object of the present invention is to provide a decorative article providing means for including environmental elements into an art ensemble.

Yet another object of the present invention is to provide a decorative article providing means for incorporating the environmental elements of earth and fire into an art ensemble.

Another object of the present invention is to provide a decorative article providing means for incorporating the environmental elements of wind, earth and fire into an art ensemble.

Yet another object of the present invention is to provide a decorative article providing means for incorporating user selected environmental elements, as aforementioned, bringing aesthetic qualities and harmony, as described in Feng Shui, into one's home.

Still yet another object of the present invention is to provide a decorative article that can be wall mounted.

Another object of the present invention is to provide a decorative article comprising cavity facing sconce-like elements.

Yet another object of the present invention is to provide a decorative article with a planar backing positioned between the sconce-like elements.

Still yet another object of the present invention is to provide a decorative article wherein said sconce-like elements are curvilinear in shape.

Another object of the present invention is to provide a decorative article wherein the sconce-like elements are comprised of polygonal shapes, such as triangular, quadrilateral or trapezoidal.

Yet another object of the present invention is to provide a decorative article wherein the opposing sconce-like articles are of similar or dissimilar shape.

Still yet another object of the present invention is to provide a decorative article wherein the sconce-like element forming the base has a cavity for the placement therein of containerized fuel.

Another object of the present invention is to provide a decorative article wherein the sconce-like element forming the base is spaced for the inclusion of containerized fuel and other decorative articles.

Yet another object of the present invention is to provide a decorative article wherein the sconce-like element forming the base is provides means for containing one or more environmental elements, such as fire, earth, and wind.

Additional objects of the present invention will appear as the description proceeds.

The present invention overcomes the shortcomings of the prior art by providing a wall mountable decorative ornamental structure for displaying the environmental element fire using solid and/or liquid containerized fuels.

The decorative ornamental structure is comprised of spaced apart sconce-like elements with a planar decorative backing plate positioned therebetween. The sconce-like elements include curvilinear as well as polygonal surface shapes that can be mixed and matched.

The sconce-like elements have facing cavities with a planar backplate forming an integral part therewith, whereby the article can be wall mounted.

The base sconce forms the housing for the containerized fuel and is dimensioned to receive additional decorative articles, such as stones giving the appearance of flames emanating from a rock bed.

The decorative ornamental structure incorporating the containerized fuel and decorative bed articles forms an art ensemble designed to bring the energy of an environmental element (fire) into one's own environment (home) creating an aesthetic quality and harmony as recited in the teaching of Feng Shui.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
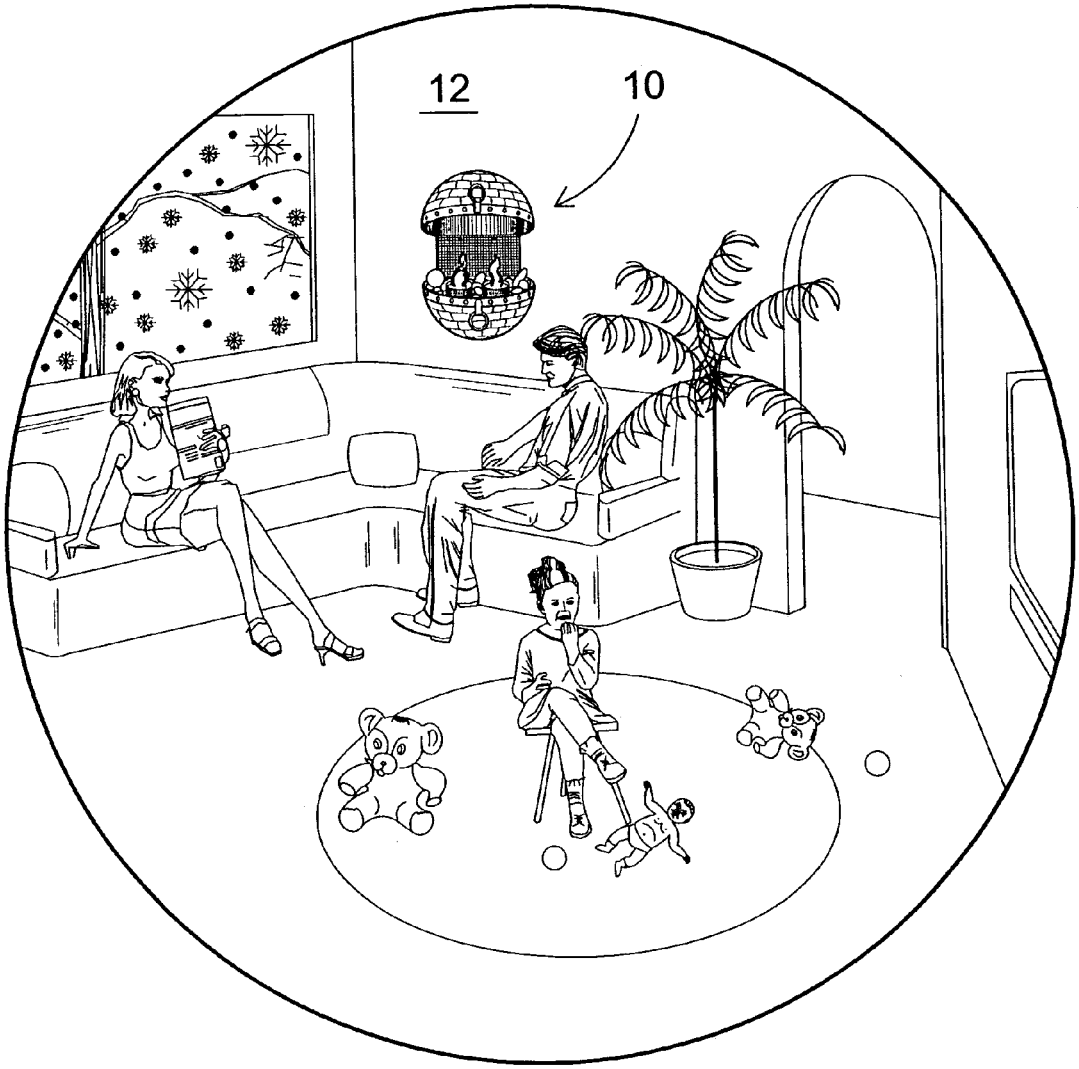
FIG. 1 is an illustrative view of the present invention in use.

With regard to reference numerals used, the following numbering is used throughout the drawings.

10 present invention
12 wall
14 top portion
16 bottom portion
18 apertures
20 back
22 gelfuel can containers
24 decorative items
26 handle
28 handle
30 gelfuel can
32 insulation

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. Shown is a wall 12 mounted, ventless, odorless smokeless decorative fireplace having mounting apertures selectively placed on the upper portion of an integral insulation member. The device 10 comprises opposing sconce-like elements having facing cavities with a decorative backplate forming an integral part therewith. The base sconce-like element provides means for positioning containerized fuel cells and other user selectable decorative articles, such as stones. The wall 12 mountable decorative article 10 provides means for displaying the environmental elements of fire and earth. The device 10 is provided in a plurality of sizes and colors and can be made of various materials such as copper, tin, ceramic or other materials.

Figure 2:
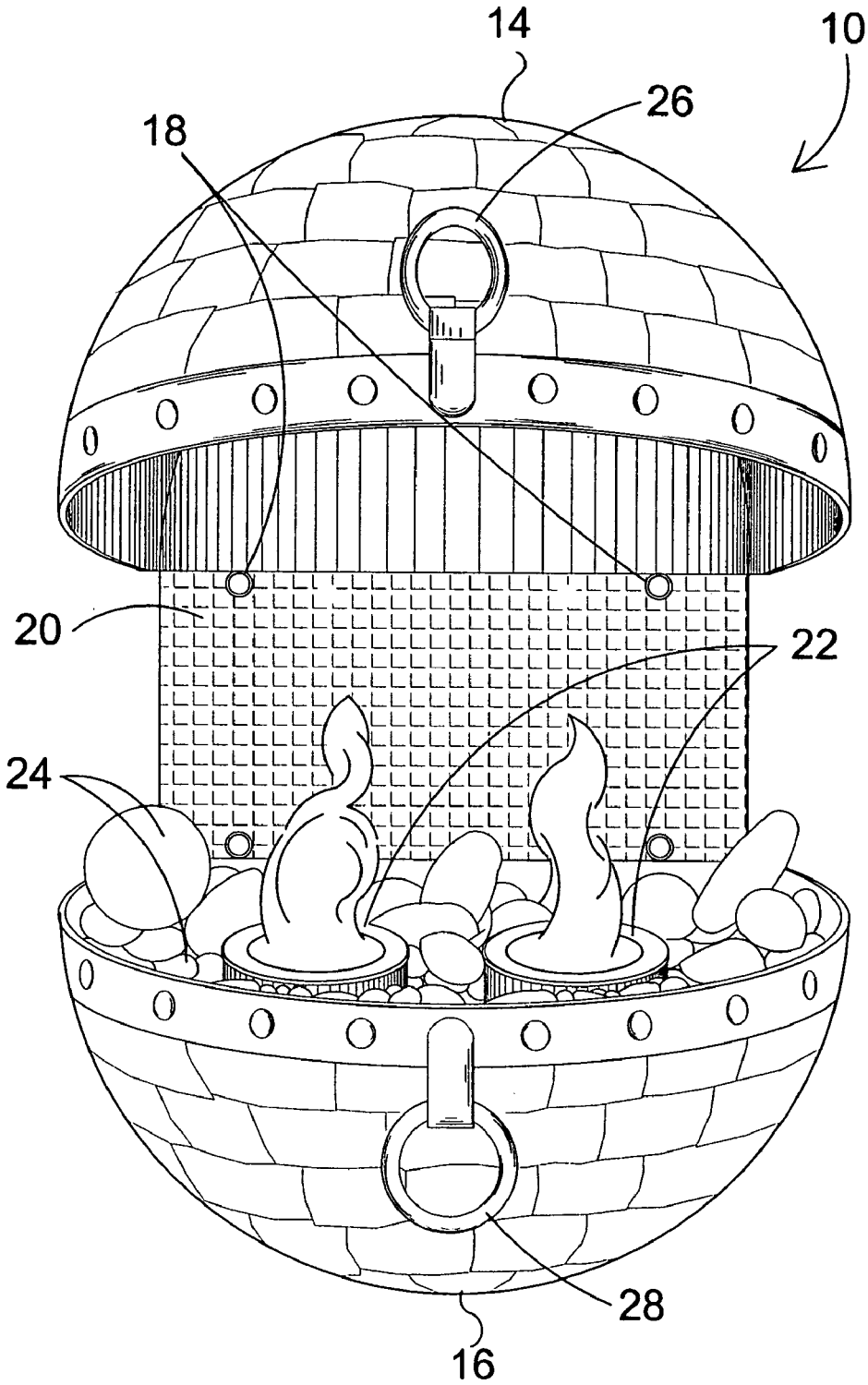
FIG. 2 is a perspective view of the invention in use.

Turning to FIG. 2, shown therein is a perspective view of the present invention 10 in use. Shown is the present invention 10 disclosing a wall mounted, ventless, odorless smokeless decorative fireplace with top 14 and bottom 16 portions having multiple mounting apertures 18 selectively placed on a decorative back plate 20, behind which an integral insulation member is hidden. The device 10 comprises a plurality of gelfuel type containers 22 that require the user to ignite for use. The device 10 can be placed anywhere in a room without moving furniture and be visible from any angle a user is located within that room. The design is perfect for apartments and other dwellings where no chimney is available. Also shown multiple decorative items 24 and top and bottom movable decorative handles 26, 28.

Figure 3:
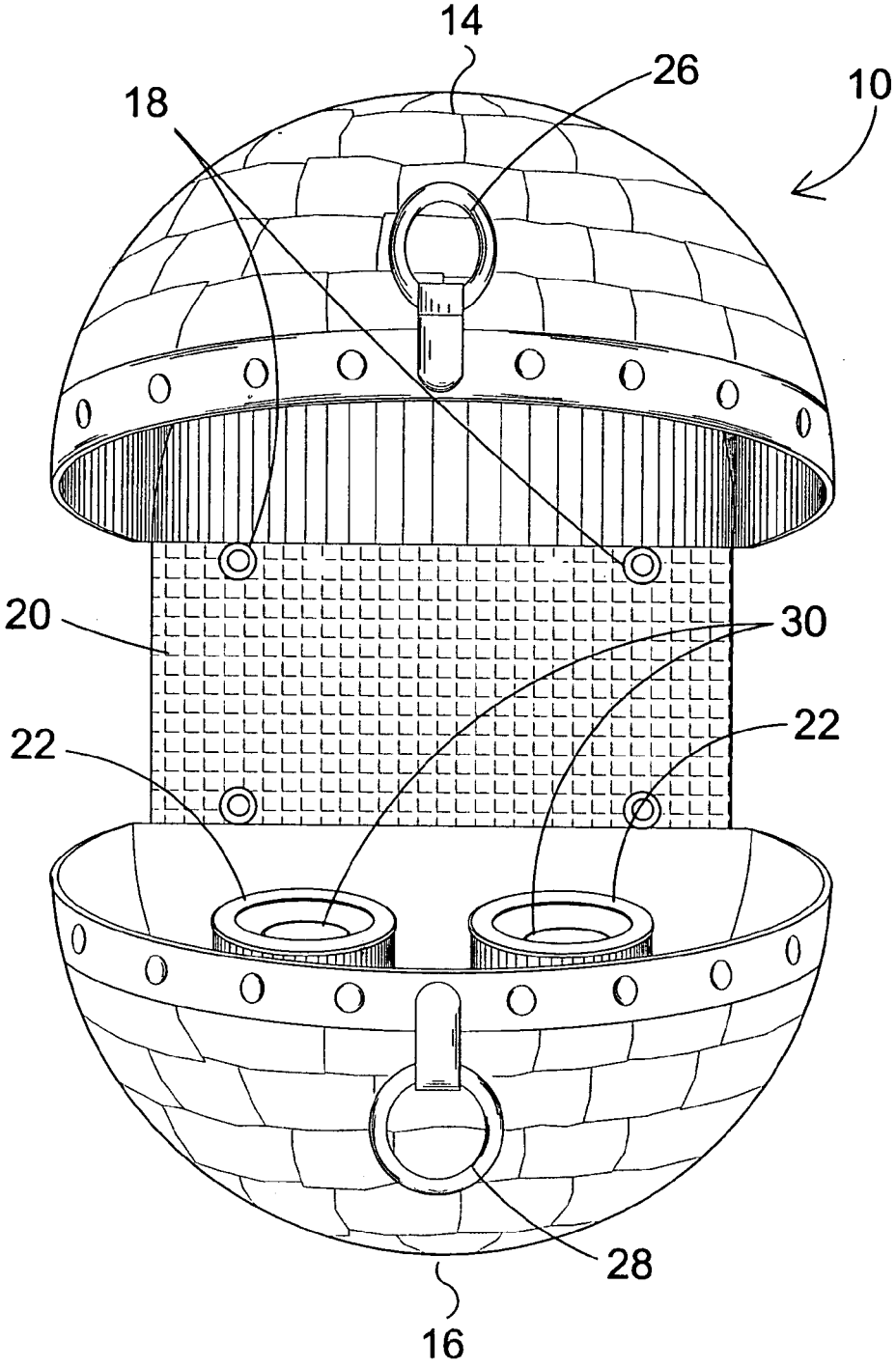
FIG. 3 is a perspective view of the present invention.

Turning to FIG. 3, shown therein is a perspective view of the present invention 10. Shown is the present invention 10 disclosing a wall mounted, ventless, odorless smokeless decorative fireplace having decorative mounting apertures 18 selectively placed on a decorative back 20, behind which an integral insulation member is hidden. The device 10 comprises a plurality of gelfuel type containers 22 with gelfuel cans 30 that require the user to ignite for use. The device 10 can be placed anywhere in a room without moving furniture and be visible from any angle a user is located within that room. The design is perfect for apartments and other dwellings where no chimney is available. Other previously disclosed elements are also shown.

Figure 4:
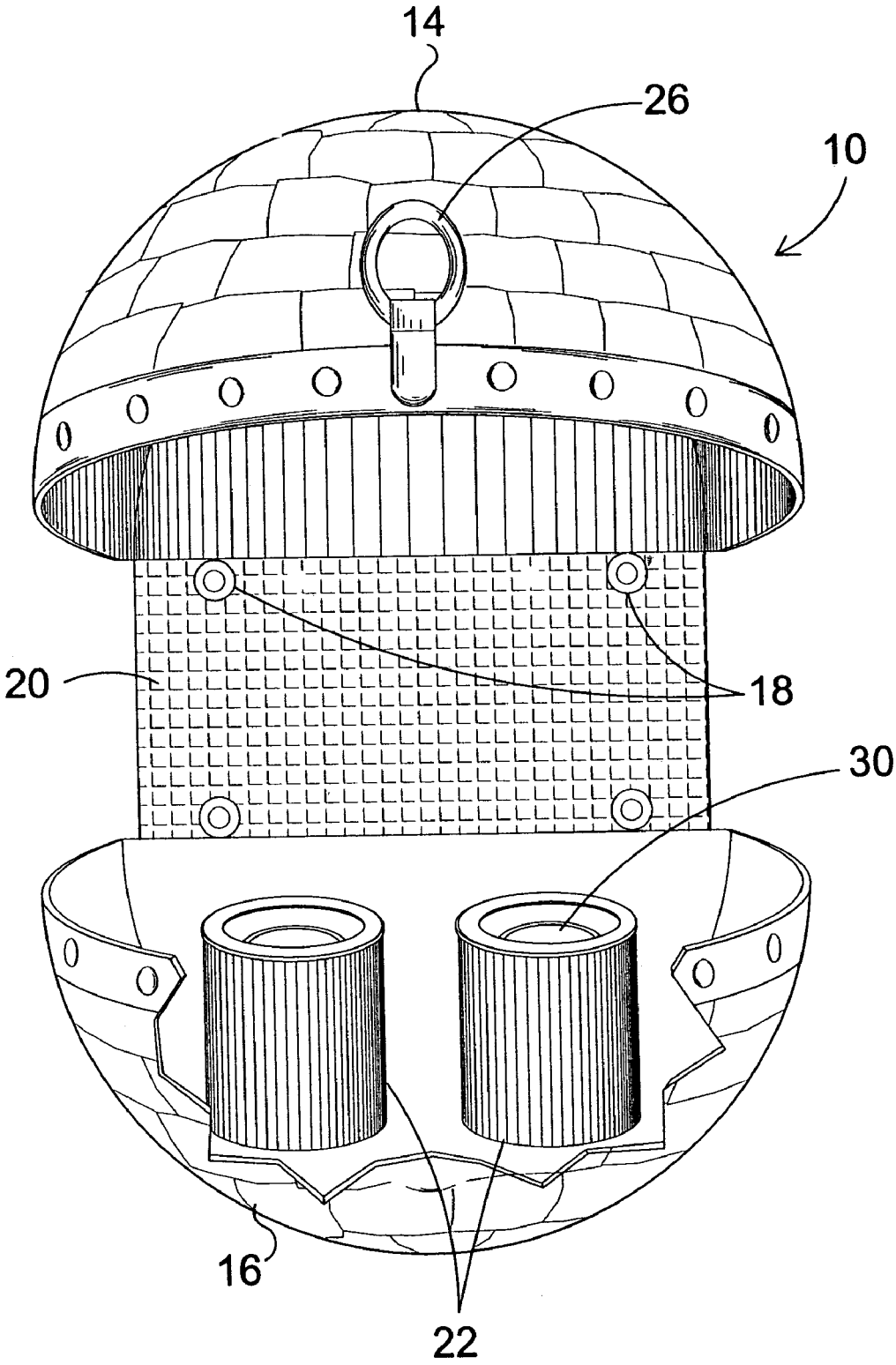
FIG. 4 is a cutaway view of the present invention.

Turning to FIG. 4, shown therein is a cutaway view of the present invention 10. Shown is a cutaway view of the present invention 10 disclosing a wall mounted, ventless, odorless smokeless decorative fireplace having mounting apertures 18 selectively placed on an integral insulation member. The device 10 comprises a plurality of gelfuel type containers 22 that require the user to ignite for use. The device 10 can be placed anywhere in a room without moving furniture and be visible from any angle a user is located within that room. In FIG. 4 the sconces 14, 16 are taller than and wider than the back plate 20. Other previously disclosed elements are also shown.

Figure 5:
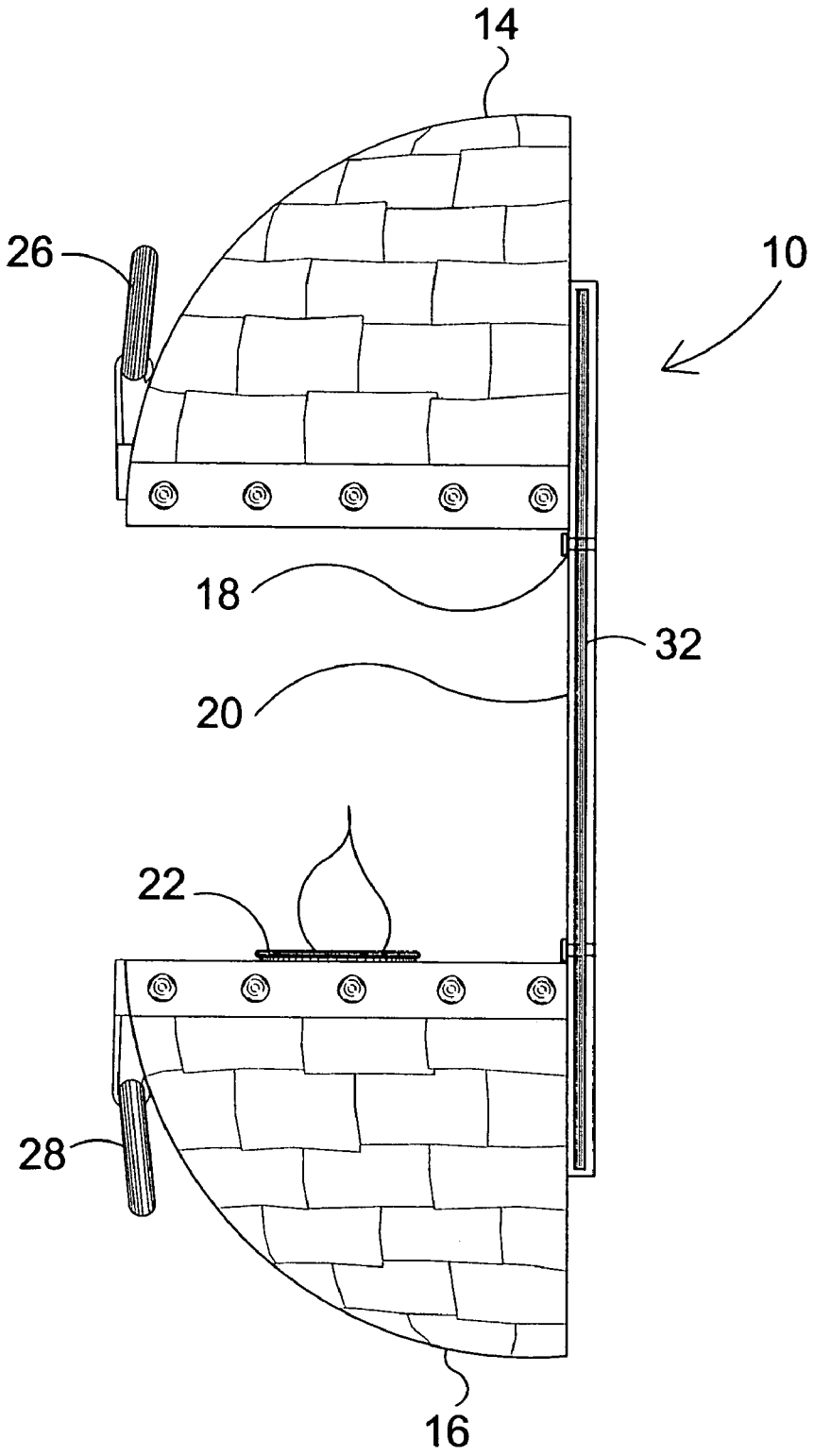
FIG. 5 is a side view of the present invention.

Turning to FIG. 5, shown therein is a side view of the present invention 10. Shown is a side view of the present invention 10 disclosing a wall mounted, ventless, odorless smokeless decorative fireplace having mounting apertures 18 selectively placed on an integral insulation member 32. The device 10 comprises a plurality of gelfuel type containers 22 that require the user to ignite for use. The device 10 can be placed anywhere in a room without moving furniture and be visible from any angle a user is located within that room. Other previously disclosed elements are also shown.

Figure 6:
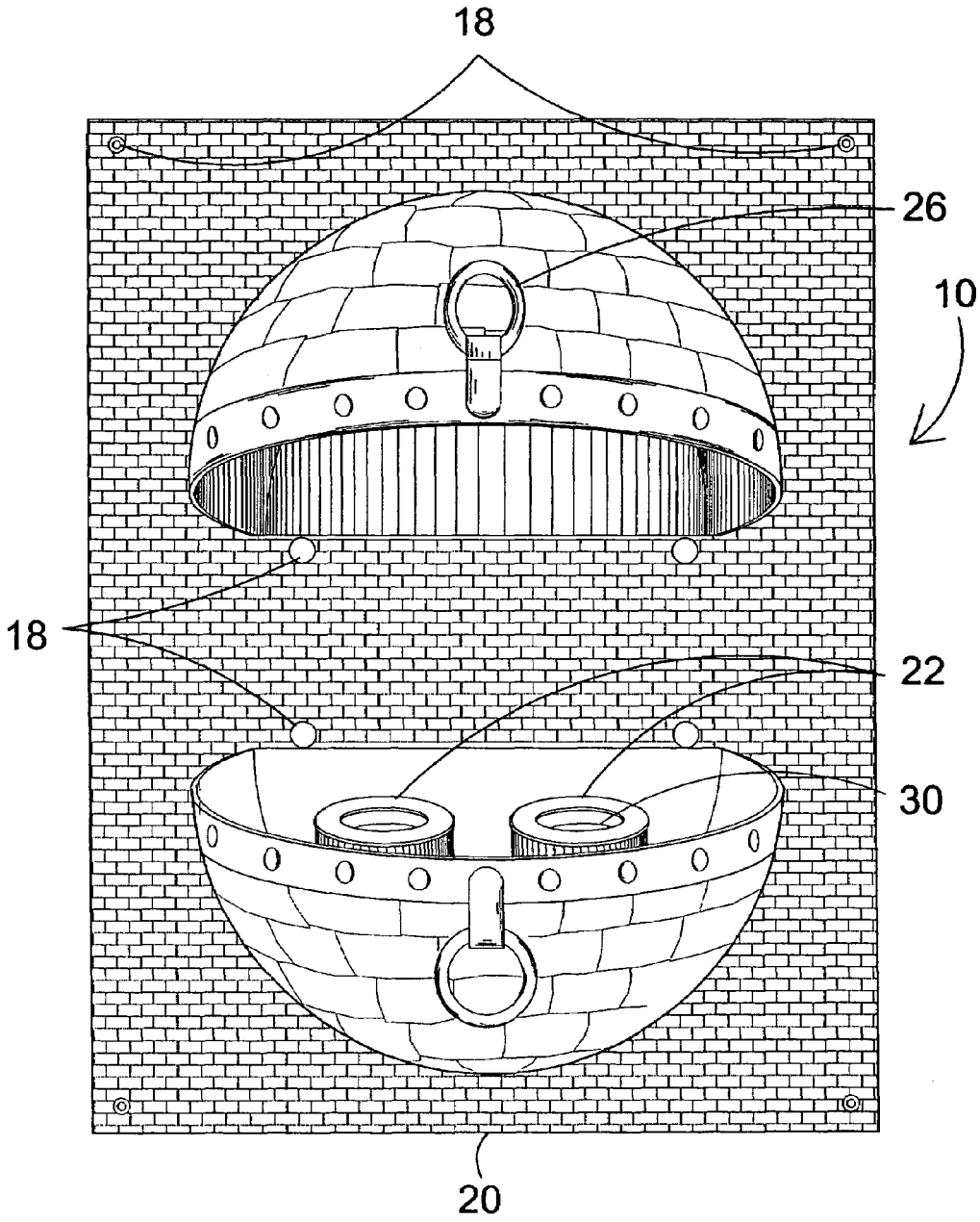
FIG. 6 is an alternate view of the present invention.

Turning to FIG. 6, shown therein is an alternate view of the present invention 10. Shown is an alternate design of the present invention 10 disclosing a wall mounted, ventless, odorless smokeless decorative fireplace having a back wall mounting member 20 with apertures 18 and an insulation member. The device 10 comprises a plurality of gelfuel type containers 22 that require the user to ignite for use. The device 10 can be placed anywhere in a room without moving furniture and be visible from any angle a user is located within that room. In FIG. 6 the sconces 14, 16 are shorter than and narrower than the back plate 20. Other previously disclosed elements are also shown.

Figure 7:
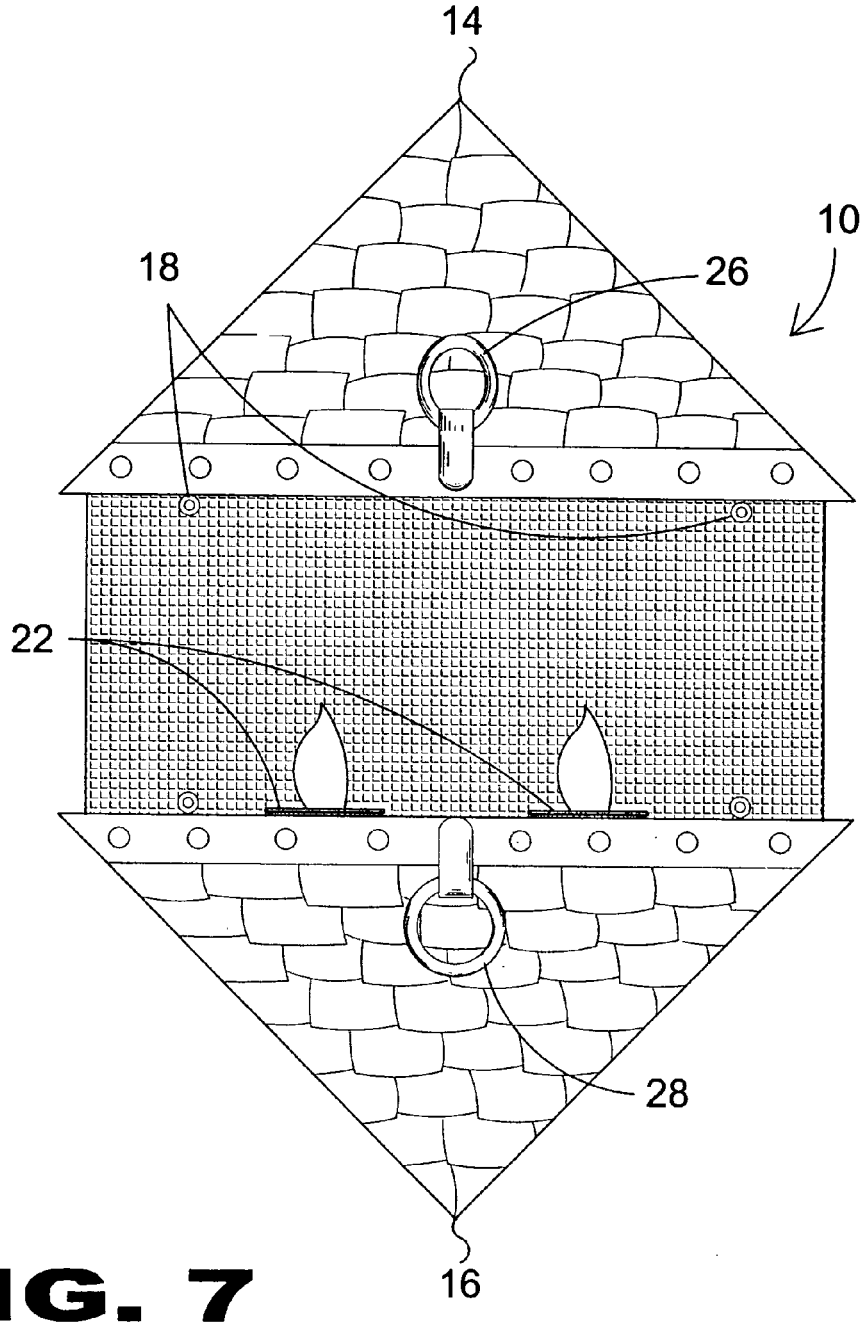
FIG. 7 is an alternate view of the present invention.

Turning to FIG. 7, shown therein is an alternate view of the present invention 10. Shown is another alternate design of the present invention 10 disclosing a wall mounted, ventless, odorless smokeless decorative fireplace having a wall mounting member with apertures 18 and an insulation member. The device 10 comprises a plurality of gelfuel type containers 22 that require the user to ignite for use. The device 10 can be placed anywhere in a room without moving furniture and be visible from any angle a user is located within that room. Other previously disclosed elements are also shown.

Figure 8:
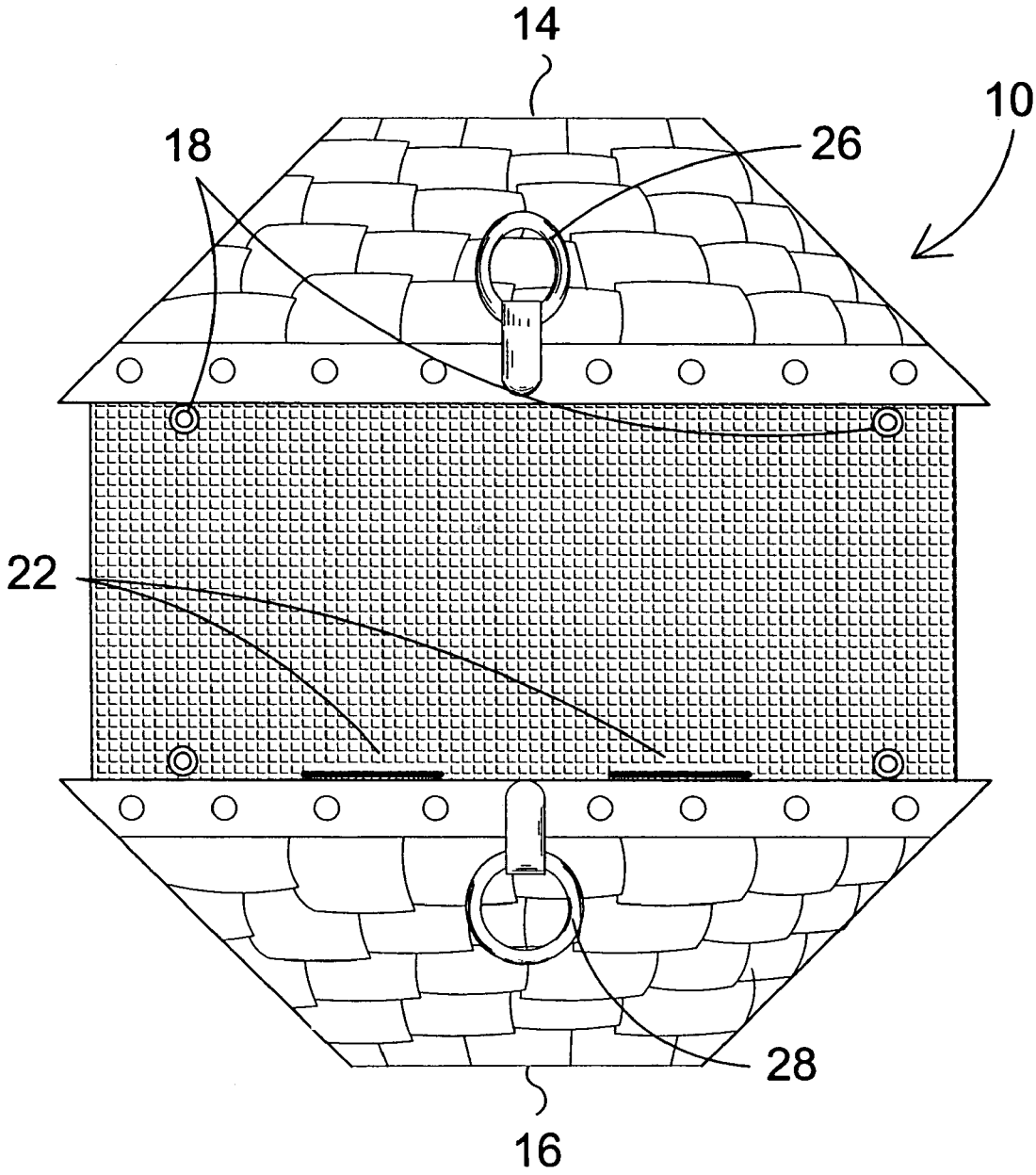
FIG. 8 is an alternate view of the present invention.

Turning to FIG. 8, shown therein is an alternate view of the present invention 10. Shown is another alternate design of the present invention 10 disclosing a wall mounted, ventless, odorless smokeless decorative fireplace having a wall mounting member with apertures 18 and an insulation member. The device 10 comprises a plurality of gelfuel type containers 22 that require the user to ignite for use. The device 10 can be placed anywhere in a room without moving furniture and be visible from any angle a user is located within that room. Other previously disclosed elements are also shown.

I claim:

1. An apparatus for a decorative fixture for being mounted on a wall, the decorative fixture for having decorative articles placed therein, comprising:

a) a sconce having a first upper portion and a second lower portion, wherein said first and second portions each having a front and rear surface and a cavity therein, wherein said first and second portions are spaced apart and being co-aligned with a line connecting the highest point of said upper portion and the lowest point of said lower portion, wherein said upper portion is downwardly concave and said lower portion is upwardly concave so that said cavities of said first and second portions face each other to permit a decorative article to be placed in the lower portion;

b) a back plate having front and rear surfaces, wherein said rear surface of said upper and lower portions are disposed on said front surface of said back plate, said rear surface of said back plate being disposed so as to display the apparatus; and, c) insulation being disposed between said rear surface of said back plate and the wall so as to insulate the wall from the apparatus.

2. The apparatus of claim 1, further comprising at least one handle being disposed on at least one of said upper and lower portions.

3. The apparatus of claim 2, wherein said handle is movable.

4. The apparatus of claim 3, wherein said back plate has a plurality of apertures therein, wherein said back plate is attached to the wall by having a fastener pass through each of said apertures into the wall.

5. The apparatus of claim 4, wherein said first and second portions are wider than said back plate.

6. The apparatus of claim 4, wherein said first and second portions are narrower than said back plate.

7. The apparatus of claim 6, wherein said first and second portions are taller than said back plate.

8. The apparatus of claim 6, wherein said first and second portions are shorter than said back plate.

9. The apparatus of claim 8, wherein said first and second portions are triangular shaped.

10. The apparatus of claim 8, wherein said first and second portions are quadrilateral shaped.

11. The apparatus of claim 8, wherein said first and second portions are trapezoidal shaped.

12. The apparatus of claim 11, wherein containerized fuel is placed in said lower portion to provide a decorative apparatus.

13. The apparatus of claim 12, wherein a gelfuel can is placed in said lower portion to provide a decorative apparatus.

14. The apparatus of claim 13, wherein a container for receiving a gelfuel can is placed in said lower portion to provide a decorative apparatus.

* * * * *